US007011234B2

(12) United States Patent
Stradella

(10) Patent No.: US 7,011,234 B2
(45) Date of Patent: Mar. 14, 2006

(54) DEVICE FOR DISPENSING COMBINED DOSES OF FLUID PRODUCT

(75) Inventor: Giuseppe Stradella, Camogli (IT)

(73) Assignee: Valois SAS, Le Neubourg (FR)

( * ) Notice: Subject to any disclaimer, the term of this patent is extended or adjusted under 35 U.S.C. 154(b) by 275 days.

(21) Appl. No.: 10/250,432

(22) PCT Filed: Jan. 3, 2002

(86) PCT No.: PCT/FR02/00014

§ 371 (c)(1),
(2), (4) Date: Jun. 30, 2003

(87) PCT Pub. No.: WO02/053294

PCT Pub. Date: Jul. 11, 2002

(65) Prior Publication Data

US 2004/0050864 A1 Mar. 18, 2004

(30) Foreign Application Priority Data

Jan. 4, 2001 (FR) ..... 01 00063

(51) Int. Cl.
*B67D 5/56* (2006.01)

(52) U.S. Cl. ..... 222/129; 222/137; 222/391; 604/223; 604/209; 604/187

(58) Field of Classification Search ..... 222/129, 222/135, 136, 137, 386, 391; 604/89–92, 604/191, 208, 209, 218, 187, 223, 227, 228
See application file for complete search history.

(56) References Cited

U.S. PATENT DOCUMENTS

| | | | | |
|---|---|---|---|---|
| 2,591,046 | A * | 4/1952 | Brown | 604/90 |
| 4,444,560 | A * | 4/1984 | Jacklich | 604/224 |
| 4,710,178 | A * | 12/1987 | Henri et al. | 604/209 |
| 4,820,286 | A * | 4/1989 | van der Wal | 604/89 |
| 5,169,039 | A * | 12/1992 | Kay et al. | 222/509 |
| 5,637,100 | A * | 6/1997 | Sudo | 604/238 |

FOREIGN PATENT DOCUMENTS

| | | |
|---|---|---|
| DE | 196 10 456 A | 9/1997 |
| EP | 0 923 993 A | 6/1999 |
| FR | 686 891 A | 9/1930 |
| FR | 2 773 135 A | 7/1999 |
| JP | 10179739 A | 7/1998 |

* cited by examiner

*Primary Examiner*—Patrick Brinson
(74) *Attorney, Agent, or Firm*—Sughrue Mion, PLLC

(57) ABSTRACT

A fluid dispenser device comprising a body (1), dispensing means (30) for dispensing the fluid, a first reservoir (10) containing a first fluid and a second reservoir (20) containing a second fluid, the first and second fluids being to be mixed prior to dispensing so as to form one or more doses of fluid to be dispensed, said fluid dispenser device being characterized in that it further comprises a mixture-forming system for mixing the first and second fluids in one of said reservoirs (10, 20), said mixture-forming system having a manual actuating element (50) that is mounted to move in a direction that is substantially perpendicular to the direction in which the fluid is dispensed, said manual actuating element (50) being actuatable with one hand and acting, after said first and second fluids have been mixed, to actuate the dispensing means (30) for dispensing the fluid, without any further manipulation of the device being necessary.

19 Claims, 5 Drawing Sheets

DEVICE FOR DISPENSING COMBINED DOSES OF FLUID PRODUCT

The present invention relates to a fluid dispenser, and more particularly to a "combidose" type, i.e. in which two distinct fluids are stored separately in the device, said two fluids being mixed with each other prior to being dispensed by the device.

Such devices of the combidose type are known from the state of the art, and in particular from Document WO 99/34 853. That document discloses a combidose device in which the user firstly exerts axial force on the end-wall of the device for mixing the two fluids, secondly turns the bottom portion of the device, and thirdly applies a second axial force to the end-wall of the device in order to dispense the resulting mixture through the dispensing orifice. In certain cases, it is desirable to have a device that can be actuated entirely with one hand, both for forming the mixture, and then for dispensing it in one or more doses. Furthermore, it is also sometimes desirable not to have to exert any axial force on the end-wall of the device, such an axial force involving a risk of discomfort and even of injury occurring inside the nostril, when the device is a nasal dispenser device.

An object of the present invention is to provide a fluid dispenser device of the combidose type that does not reproduce the above-mentioned drawbacks, while being simple, and inexpensive to manufacture and to assemble.

An object of the invention is to provide a fluid dispenser device of the combidose type that can be actuated entirely with one hand, both for forming the mixture of the two fluids, and for dispensing it in one or more doses.

An object of the present invention is also to provide a fluid dispenser device of the combidose type that does not require any axial force to be applied to the end-wall of the device, in order to avoid any risks of injury, and in order to make it easier to use, in particular when the device is manipulated by a third party.

An object of the present invention is thus to provide a fluid dispenser device of the combidose type that is simple and reliable to use, even for children, elderly people, or handicapped people to use.

The present invention thus provides a fluid dispenser device comprising a body, dispensing means for dispensing the fluid, a first reservoir containing a first fluid and a second reservoir containing a second fluid, the first and second fluids being to be mixed prior to dispensing so as to form one or more doses of fluid to be dispensed, said fluid dispenser device being characterized in that it further comprises a mixture-forming system for mixing the first and second fluids in one of said reservoirs, said mixture-forming system having a manual actuating element that is mounted to move in a direction that is substantially perpendicular to the direction in which the fluid is dispensed, said manual actuating element being actuatable with one hand and acting, after said first and second fluids have been mixed, to actuate the dispensing means for dispensing the fluid, without any further manipulation of the device being necessary.

Advantageously, the mixture-forming system comprises a first piston mounted to slide in the first reservoir, a passageway interconnecting the two reservoirs, and one or more pegs co-operating firstly with said piston and secondly with the actuating element, in particular via a cam surface on said element, which cam surface transforms the substantially lateral motion of the actuating element into axial motion of the first piston so as to transfer the fluid contained in the first reservoir to the second reservoir through said passageway.

Advantageously, said passageway is provided with a check valve.

In a first variant embodiment, the fluids are mixed by actuating the mixture-forming means once only.

In a second variant embodiment, the fluids are mixed by actuating the mixture-forming means a plurality of times, the device having a plurality of pegs offset axially and co-operating in succession with said first piston so as to move it axially in the first reservoir.

Advantageously, the actuating element is provided with resilient means for returning it to its rest position after each occasion on which it is actuated.

Advantageously, the actuating element is pivotally mounted on one side of said body, and it is preferably provided with energy accumulation means and/or with abutment means limiting the stroke of the actuating element in predetermined manner.

In a first embodiment, the device is a single-dose device, the mixture of said first and second fluids being dispensed in a single dose, by actuating the actuating element once only.

Advantageously, the second reservoir is provided with a second piston, at least one peg co-operating firstly with said second piston and secondly with the actuating element to dispense the mixture contained in the second reservoir.

In a second embodiment, the device is a multi-dose device, the mixture of said first and second fluids being dispensed in a plurality of part doses, by actuating the actuating element a plurality of times in succession.

Advantageously, said device further comprises dose subdivision means for separating the fluid mixture into part doses, the part doses being dispensed in succession merely by actuating said actuating element manually a plurality of times in succession, without any further manipulation of the device being necessary, without having to use both hands, and without having to turn one or more component portions of the device relative to each other between occasions on which a part dose is dispensed.

Advantageously, the dose subdivision means comprise pegs for respective ones of the part doses, which pegs co-operate firstly with the dispensing means and secondly with the actuating element.

Advantageously, the device is a two-dose device, the mixture of said first and second fluids being dispensed in two half-doses by actuating the actuating element twice in succession.

Advantageously, the respective pegs are provided with non-return means preventing them from moving axially in the direction opposite to the direction imparted by actuating the manual actuating element.

Advantageously, one of the first and second fluids is a powder and the other is a solvent.

Other characteristics and advantages of the present invention appear more clearly from the following detailed description of a particular embodiment of said invention, given with reference to the accompanying drawings which are given by way of non-limiting example, and in which.

Figure 1:
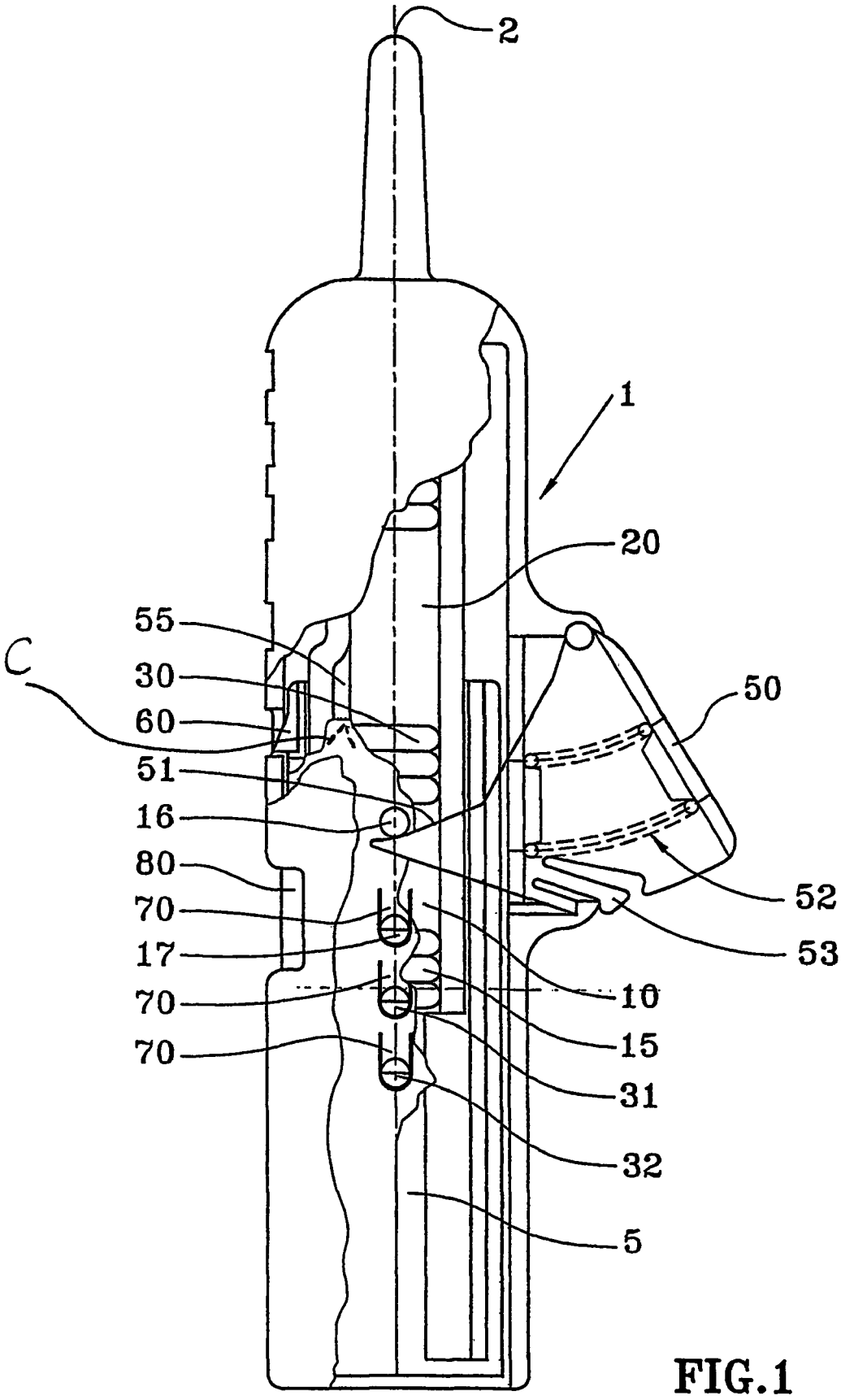
FIG. 1 is a partially-cutaway diagrammatic section view showing a fluid dispenser device of the combidose type in a particular embodiment of the present invention, in the rest position before the mixture is formed.
Figure 2:
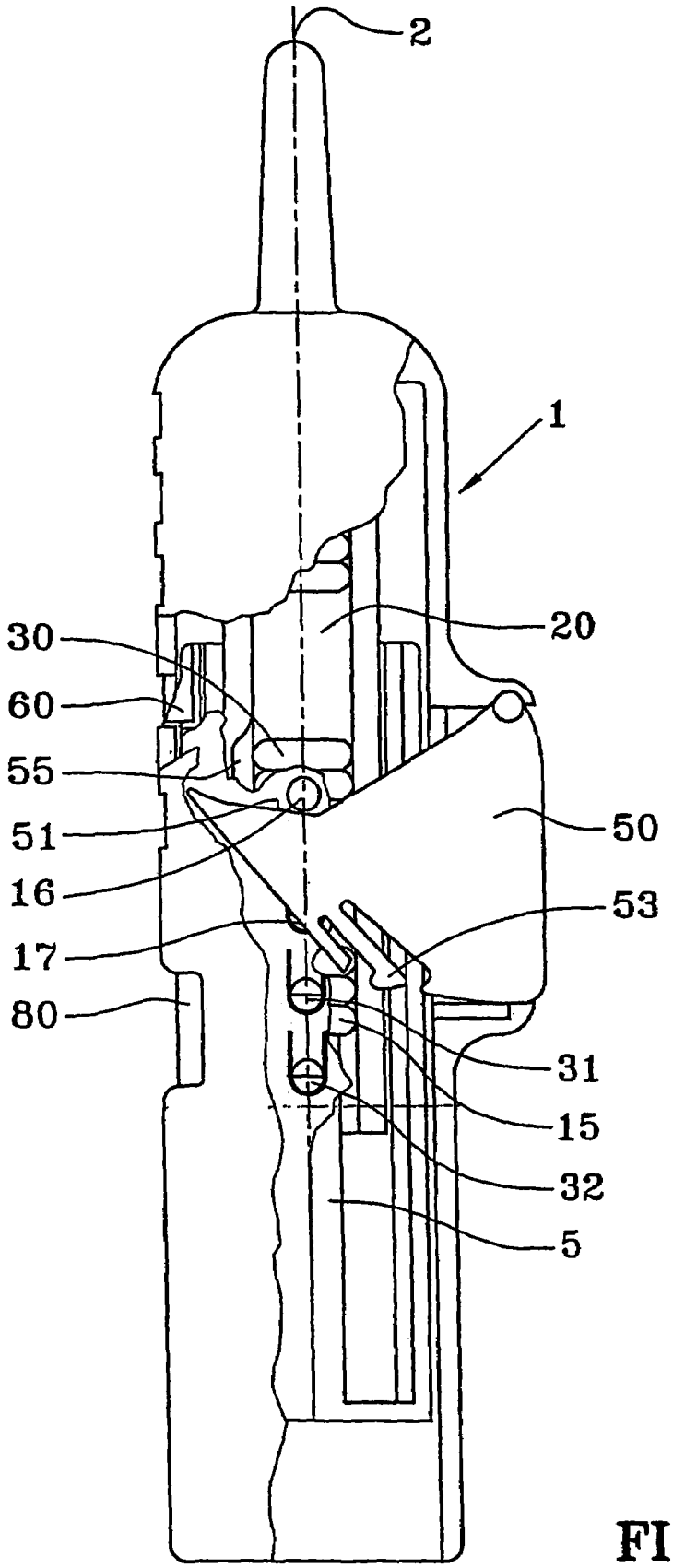
FIG. 2 is a view similar to FIG. 1, after the mixture has been formed in part.

The present invention is described below with reference to a fluid dispenser device of the combidose type, implemented in the form of a nasal-type two-dose dispenser. However, it is naturally to be understood that the present invention is also applicable to single-dose dispensers or to multi-dose dispensers for dispensing more than two doses, and that it is also applicable to fluid dispenser devices of types other than nasal.

As shown in the figures, the fluid dispenser device includes a body 1 incorporating a dispensing orifice 2. A first reservoir 10 that contains a first fluid and a second reservoir 20 that contains a second fluid are received inside the body 1. Advantageously, one of the fluids may be a powder and the other fluid may be a solvent, but it is also possible to envisage having two fluids containing respective active substances, it being necessary to mix said active substances before they are dispensed.

In the invention, said first and second fluids must be mixed before the mixture is dispensed. For this purpose, the dispenser includes a mixture-forming system. In the example shown in the figures, the first fluid contained in the first reservoir 10 is to be transferred to the second reservoir 20 to be mixed with the second fluid.

The mixture-forming system advantageously comprises an actuating element 50 which co-operates with actuating means such as one or more pegs 16, 17, said pegs 16, 17 themselves co-operating with a first piston 15 disposed in said first reservoir 10. In the invention, said actuating element 50 is mounted to move substantially perpendicularly to the direction in which the fluid is dispensed, so that said device is actuated laterally, and so as to avoid applying an axial force to the end wall of the device. Advantageously, as shown in the figures, the actuating element 50 is mounted to pivot on the body 1, on a side wall of said body. Naturally, said actuating element 50 could also be mounted to slide in translation inside said body 1, or in some other similar manner. The manual actuating element 50 is advantageously provided with a cam surface 51 that is preferably a sloping surface, and that co-operates with the peg(s) 16, 17 so that the actuating element 50 moving substantially laterally causes the pegs 16 and/or 17 to move "upwards", i.e. towards the tops of the figures.

In the invention, said pegs 16 and/or 17 co-operate with said first piston 15 to move it axially inside the reservoir, in order to transfer the first fluid to the second reservoir 20. To this end, the device includes a passageway 55 connecting the first reservoir 10 to the second reservoir 20. In the example shown in the figures, said passageway 55 is provided on one side of the separator element 30 that separates the first and second reservoirs 10 and 20. Advantageously, said passageway 55 is provided with a check valve C which prevents the mixture from flowing back towards the first reservoir 10. In a variant to the example shown in the figures, it is also possible to envisage providing the passageway 55 inside the separator element 30 that separates the first and second reservoirs 10 and 20. Said passageway 55 may then be implemented in the form of a split wall which opens under the effect of the pressure exerted by the first piston 15 inside the first reservoir 10.

As shown in the figures, the pegs 16 or 17 are advantageously secured to a control element 5 which is slidably received inside the body 1, and which cooperates directly with the first piston 15.

In the example shown in the figures, the mixture-forming system includes two pegs 16 and 17 offset axially from each other so that the mixture is formed by actuating the manual actuating element 50 twice. Thus, actuating the actuating element 50 a first time moves the first peg 16 axially upwards (towards the tops of the drawings), thereby causing the control element 5 to move axially, which control element co-operates with the first piston 15. The user then releases the actuating element 50 which returns automatically to its rest position under the effect of a return spring 52, or by means of any other resilient return means.

Advantageously, the second peg 17 is provided on a resilient tab 70, and, while the first peg 16 is being actuated, said peg is urged resiliently towards a position in which it does not interfere with the actuating element 50. After the actuating element has been actuated for the first time, the resilient tab 70 urges said second peg 17 towards a position in which it can co-operate with the actuating element 50, e.g. at a groove or a shoulder (not shown) provided in the body and/or in the control element 5. Thus, the next time the actuating element 50 is actuated, it is the second peg 17 which is moved axially to move the control element 5 and thus the first piston 15 inside the first reservoir 10.

The example in the figures thus shows a mixture-forming system that operates with the actuating element 50 being actuated twice, but it is clear that the mixture could be formed by the actuating element being actuated once only. The fact that it is necessary to actuate the actuating element 50 twice is due to the facts that the device shown is a two-dose dispenser, and that such an implementation considerably simplifies the construction of the device.

Figure 3:
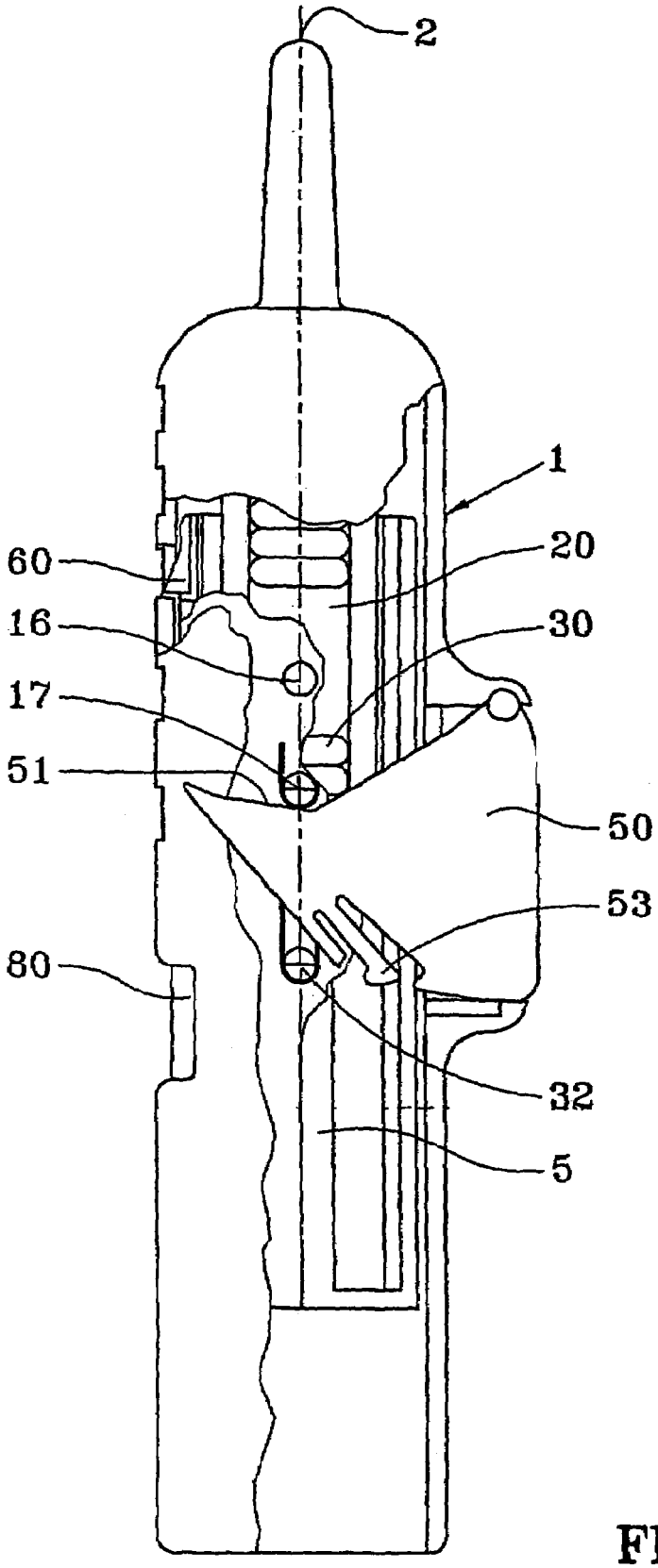
FIG. 3 is a view similar to FIG. 1, after the mixture has been formed in full, and before said mixture is dispensed.
Figure 4:
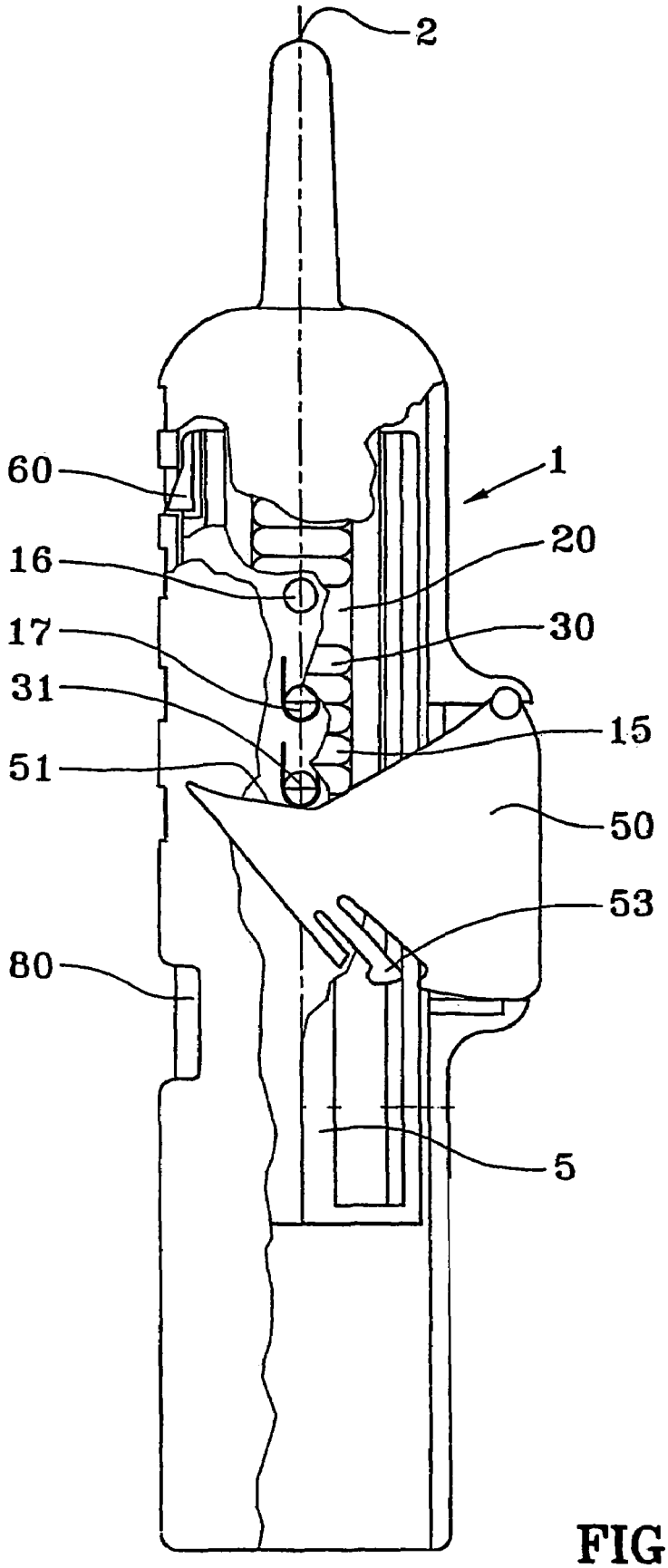
FIG. 4 is a view similar to FIG. 1, after the first half-dose has been dispensed.
Figure 5:
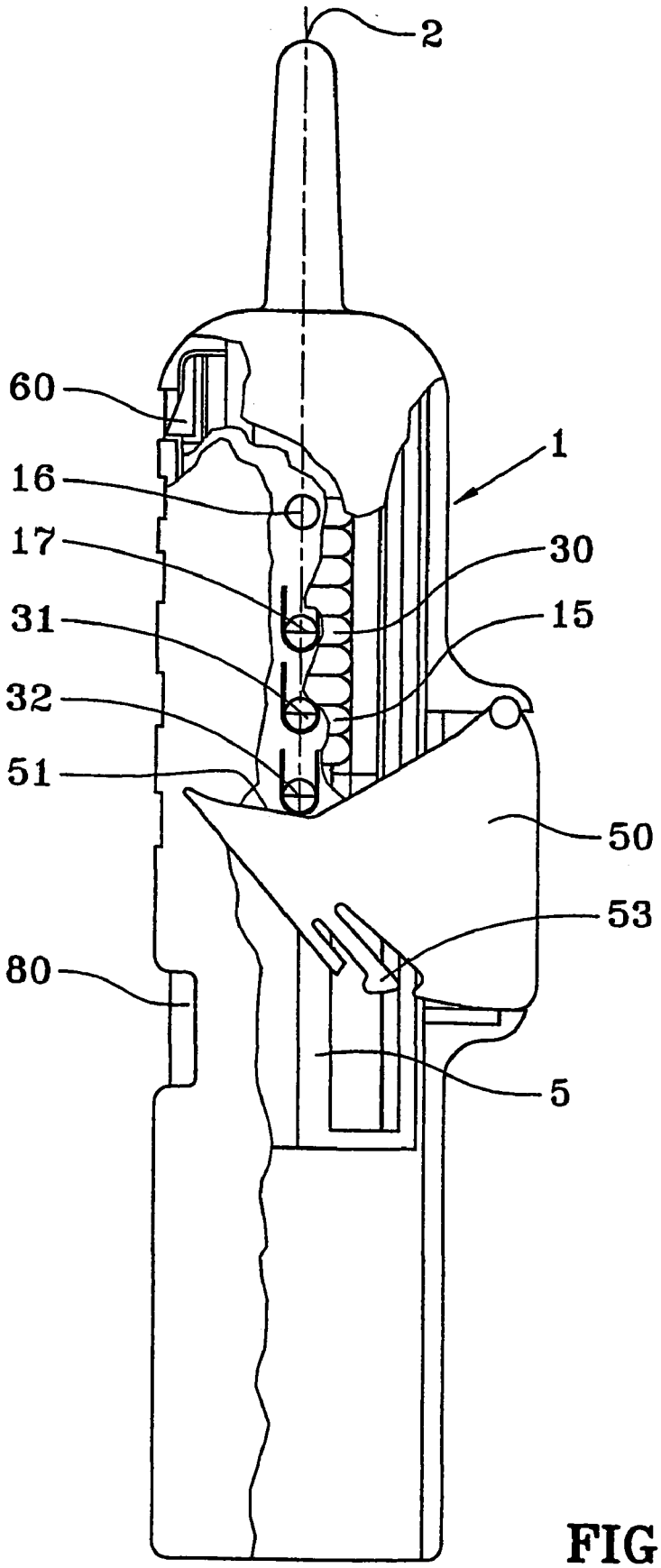
FIG. 5 is a view similar to FIG. 1, after the second half-dose has been dispensed.

When the mixture is formed in the second reservoir 20, as is shown in FIG. 3, said mixture can then be dispensed through the dispensing orifice 2. In the invention, the dispensing is also performed by means of the lateral actuating element 50, without having to use the other hand, and without having to turn two or more component elements of the device relative to each other to any extent. For this purpose, the second reservoir 20 is provided with a second piston 30 which is preferably the separator element that separates the first and the second reservoirs 10 and 20. Once the mixture has been formed in full in the second reservoir 20, the first piston 15 is in contact with the second piston 30, and moving the control element 5 upwards then causes said second piston 30 to move inside the second reservoir 20, thereby causing the mixture to be dispensed through the dispensing orifice 2. Advantageously, the dispensing means also include one or more pegs 31 and 32 offset axially relative to the pegs 16, 17 of the mixture-forming system, and preferably also implemented on resilient tabs 70 so as to enable them to co-operate in succession with the actuating element 50 each time said element is actuated. The actuating element 50, and in particular its cam surface 51, co-operates with the pegs 31, 32 in a manner entirely similar to the manner described above with reference to the mixture-forming system.

Advantageously, the actuating element 50 is provided with energy accumulation means 53 which, for example may be implemented in the form of a resilient tab that prevents the actuating element 50 from being actuated until a threshold force is applied to it. The energy accumulation means 53 are particularly advantageous for guaranteeing that each full dose or part dose of the mixture contained in the second reservoir 20 is dispensed properly. Similarly, the actuating element 50 may be provided with abutment means (not shown) which predetermine the stroke of the actuating element 50, and therefore the stroke of the second piston 30 in order to subdivide the mixture contained in the second reservoir into part doses very accurately. In a variant, the abutment means could also be implemented at the control element 5 and/or at the pegs 30, 31 in order to subdivide the doses of the mixture in this way.

In the example shown in the figures, the device is a two-dose device, and the dispenser means thus include two pegs 31 and 32, procuring dispensing of the mixture in two half-doses. If more than two part doses are desired, it is necessary merely to provide a corresponding number of additional pegs. Naturally, when the device is a single-dose device, the device has a single peg for dispensing the mixture in a single dose, by actuating the manual actuating element 50 once only. In which case, the mixture is also preferably formed by actuating the actuating element once only, and the mixture-forming system then has only one peg 16.

Advantageously, the pegs 16, 17, 31, and 32 are provided with non-return means 60 advantageously implemented in the form of a resilient tab co-operating in succession with windows provided inside the body 1 for the purpose of preventing the control element 5 from moving in the direction opposite to the direction imparted by the actuating element 50. Preferably, the non-return means 60 are formed directly on the control element 5.

Advantageously, the device is also provided with a window 80 at the first reservoir 10, for the purpose of enabling the user to see whether or not the mixture has been formed.

The invention is described above with reference to a particular embodiment of it. Clearly, various modifications may be made to this embodiment by the person skilled in the art without going beyond the ambit of the present invention as defined by the accompanying claims.

What is claimed is:

1. A nasal fluid dispense spray device comprising a body (1), dispensing means (30) for dispensing the fluid, a first reservoir (10) containing a first fluid and a second reservoir (20) containing a second fluid, the first and second fluids to be mixed prior to dispensing so as to form one or more doses of fluid to be dispensed, said fluid dispenser device being characterized in that it further comprises a mixture-forming system for mixing the first and second fluids in one of said reservoirs (10, 20), said mixture-forming system having a manual actuating element (50) that is mounted to move in a direction that is substantially perpendicular to the direction in which the fluid is dispensed, said manual actuating element (50) being actuatable with one hand and acting, after said first and second fluids have been mixed, to actuate the dispensing means (30) for dispensing the fluid, without any further manipulation of the device being necessary; said actuating element comprising energy accumulation means for preventing the actuating element from being actuated until a threshold force is applied to the actuating element.

2. A device according to claim 1, in which the mixture-forming system comprises a first piston (15) mounted to slide in the first reservoir (10), a passageway (55) interconnecting the two reservoirs (10, 20), and one or more pegs (16, 17) co-operating firstly with said piston (15) and secondly with the actuating element (50), in particular via a cam surface (51) on said element, which cam surface transforms the substantially lateral motion of the actuating element (50) into axial motion of the first piston (15) so as to transfer the fluid contained in the first reservoir (10) to the second reservoir (20) through said passageway (55).

3. A device according to claim 2, in which said passageway (55) is provided with a check valve.

4. A device according to claim 2, in which the fluids are mixed by actuating the mixture-forming means once only.

5. A device according to claim 2, in which the fluids are mixed by actuating the mixture-forming means a plurality of times, the device having a plurality of pegs (16, 17) offset axially and co-operating in succession with said first piston (15) so as to move it axially in the first reservoir (10).

6. A device according to claim 1, in which the actuating element (50) is provided with resilient means (52) for returning it to its rest position after each occasion on which it is actuated.

7. (currently amended): A device according to claim 1, in which the actuating element (50) is pivotally mounted on one side of said body (1), and it comprises abutment means limiting the stroke of the actuating element (50) in predetermined manner.

8. A device according to claim 1, in which the device is a single-dose device, the mixture of said first and second fluids being dispensed in a single dose, by actuating the actuating element (50) once only.

9. A device according to claim 8, in which the second reservoir (20) is provided with a second piston (30), at least one peg (31) co-operating firstly with said second piston (30) and secondly with the actuating element (50) to dispense the mixture contained in the second reservoir (20).

10. A device according to claim 1, in which the device is a multi-dose device, the mixture of said first and second fluids being dispensed in a plurality of part doses, by actuating the actuating element (50) a plurality of times in succession.

11. A device according to claim 10, in which said device further comprises dose subdivision means for separating the fluid mixture into part doses, the part doses being dispensed in succession merely by actuating said actuating element (50) manually a plurality of times in succession, without any further manipulation of the device being necessary, without having to use both hands, and without having to turn one or more component portions of the device relative to each other between occasions on which a part dose is dispensed.

12. A device according to claim 11, in which the dose subdivision means comprise pegs (31, 32) for respective ones of the part doses, which pegs co-operate firstly with the dispensing means (30) and secondly with the actuating element (50).

13. A device according to claim 10, in which the device is a two-dose device, the mixture of said first and second fluids being dispensed in two half-doses by actuating the actuating element (50) twice in succession.

14. A device according to claim 1, in which the respective pegs (16, 17, 31, 32) are provided with non-return means (60) preventing them from moving axially in the direction opposite to the direction imparted by actuating the manual actuating element (50).

15. A device according to claim 1, in which one of the first and second fluids is a powder and the other is a solvent.

16. A fluid spray device comprising a body, dispensing means for dispensing the fluid, a first reservoir containing a first fluid and a second reservoir containing a second fluid, the first and second fluids to be mixed prior to dispensing so as to form one or more doses of fluid to be dispensed, said fluid dispenser device being characterized in that it further comprises a mixture-forming system for mixing the first and second fluids in one of said reservoirs, said mixture-forming system having a manual actuating element that is mounted to move in a direction that is substantially perpendicular to the direction in which the fluid is dispensed, said manual actuating element being actuatable with one hand and acting, after said first and second fluids have been mixed, to actuate the dispensing means for dispensing the fluid, without any further manipulation of the device being necessary; and wherein the mixture-forming system comprises a first piston mounted to slide in the first reservoir, a passageway interconnecting the two reservoirs, and one or more pegs co-operating firstly with said piston and secondly with the actuating element, in particular via a cam surface on said element, which cam surface transforms the substantially lateral motion of the actuating element into axial motion of the first piston so as to transfer the fluid contained in the first reservoir to the second reservoir through said passageway.

17. A nasal fluid spray device comprising:

a body, a piston that dispenses the fluid;

a first reservoir comprising a first fluid;

a second reservoir comprising a second fluid;

a passageway for conveying the first fluid to the second fluid prior to dispensing so as to form one or more doses of mixed fluid in the second reservoir; and a manual actuating element mounted to move in a direction substantially perpendicular to the direction in which the fluid is dispensed, the manual actuating element configured to be actuated with one hand and acting, after the first and second fluids have been mixed, to actuate the piston to dispense the fluid; the actuating element comprising an energy accumulation elastic member that prevents the actuating element from being actuated until a threshold force is applied to the actuating element.

18. The device according to claim 1, further comprising a dispensing end configured for spraying a dose of the mixed first and second fluids in a nasal passageway.

19. The device according to claim 17, further comprising a dispensing end configured for spraying a dose of the mixed first and second fluids in a nasal passageway.

* * * * *